United States Patent [19]

Marlinski

[11] Patent Number: 4,931,625

[45] Date of Patent: Jun. 5, 1990

[54] DEVICE FOR SHIELDING ELECTROMAGNETIC RADIATION

[76] Inventor: Edward J. Marlinski, 526 W. 2nd St., Lansdale, Pa. 19446

[21] Appl. No.: 232,948

[22] Filed: Aug. 17, 1988

[51] Int. Cl.[5] ..... H05B 3/34

[52] U.S. Cl. ..... 219/528; 219/212; 219/524; 219/549; 128/399; 338/64

[58] Field of Search ..... 219/211, 212, 213, 528, 219/529, 548, 549, 524; 128/399, 402; 174/36; 338/64, 65

[56] References Cited

U.S. PATENT DOCUMENTS 2,441,005 5/1947 Bradford ..... 219/524
2,845,519 2/1954 Willat ..... 219/528
4,684,762 8/1987 Gladfelter ..... 174/36
4,798,936 1/1989 Johnson ..... 219/217

*Primary Examiner*—Bruce A. Reynolds
*Assistant Examiner*—Leon K. Fuller

[57] ABSTRACT

A device for shielding an electrically powered resistive heating means so as to block and contain the electromagnetic radiation emitted thereby is disclosed. The device includes a cover constructed and arranged to enclose the heating means, the cover having a layer of electrically conductive material and a ground connection for electrically grounding the electrically conductive layer to either system ground or earth potential.

11 Claims, 3 Drawing Sheets

FIG. 1
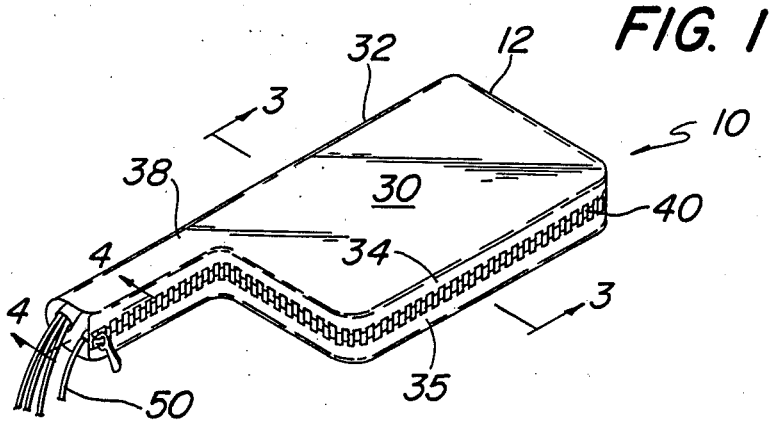
FIG. 4
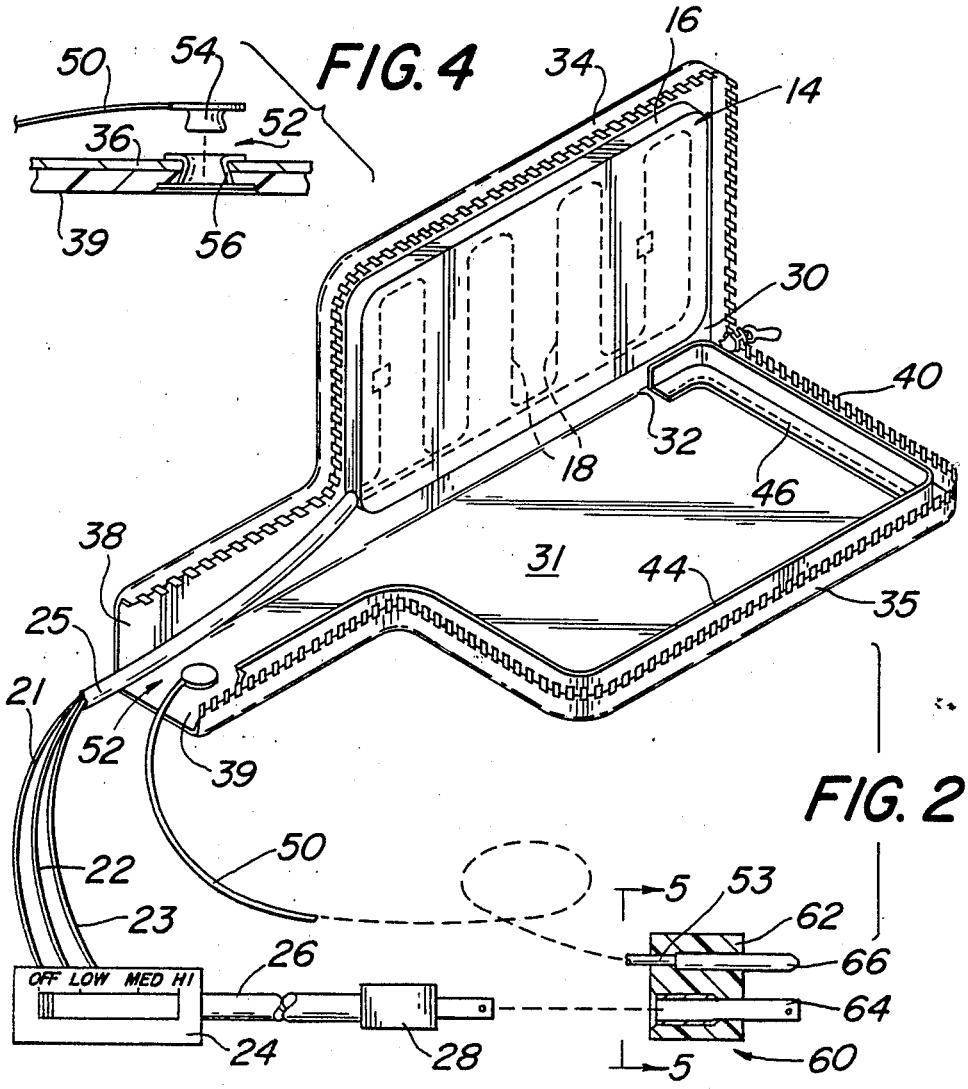
FIG. 2

DEVICE FOR SHIELDING ELECTROMAGNETIC RADIATION

BACKGROUND OF THE INVENTION

This invention relates to the field of devices for shielding an electrically powered resistive heating means.

Electrically powered resistive heating means, such as heating pads and other similar devices, are used for therapeutic measures and to provide comfort to the user thereof. Heating means of the indicated type normally use an alternating current to electrically power a resistive heating unit, such as coils contained within a body or the like. During use, the body of the heating means is typically placed in contact with or near the user thereof. A problem that has been observed by medical investigators is that there is some indication that there is a link between the occurrence of disease and people who are exposed to the electromagnetic radiation that the resistive heating unit emits when it is energized to produce its desired heating effect.

Accordingly, there is a need to obviate the health problem associated with the use of electrically powered resistive heating means and caused by the electromagnetic radiation emitted therefrom.

SUMMARY OF THE INVENTION

It is the general object of the invention to provide a shielding device which encloses an electrically powered resistive heating means so as to block and contain the electromagnetic radiation emitted thereby and, accordingly, protect the user of the heating means from any potential medical problems that may be caused.

Briefly stated, the general and other objects of the invention are achieved by the provision of a shielding device that comprises cover means including a backing and an electrically conductive layer constructed and arranged to enclose the resistive heating unit of a heating means of the indicated type. The shielding device also includes a ground means for electrically connecting the electrically conductive layer of the cover means to system ground or earth potential. In accordance with a more specific aspect of the invention, there are provided several plug adapters for connecting a ground wire from the conductive layer to system ground and or earth potential, said adapters providing a grounding arrangement for either a two prong or a three prong electrical plug conventionally used to supply power to the heating means. In accordance with another specific aspect of the invention, the cover means is provided with a body having an elongated extension portion adapted to enclose a substantial amount of the power supply wires for the heating means and provided with electrically conductive material for blocking and containing the electromagnetic radiation emitted from said power supply wires.

BRIEF DESCRIPTION OF THE DRAWINGS

FIG. 1 is a perspective view of a shielding device in accordance with the invention.

FIG. 2 is a perspective view of the device shown in FIG. 1 in an open condition and showing the power supply for the heating unit and the ground connection.

FIG. 4 is a sectional view taken on line 4—4 of FIG. 1.

DETAILED DESCRIPTION OF THE PREFERRED EMBODIMENTS

Figure 3:
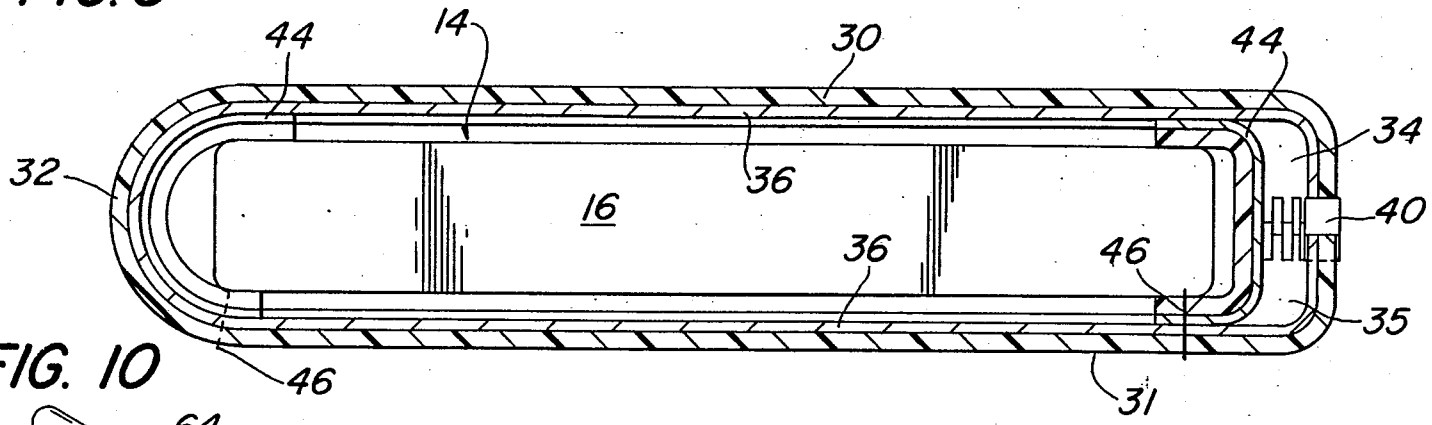
FIG. 3 is a sectional view taken on line 3—3 of FIG. 1.

Referring to FIGS. 1–5, the embodiment of the invention shown therein comprises a shielding device 10 comprising a cover 12 constructed and arranged to enclose an electrically powered resistive heating means in the form of a heating pad 14. Heating pad 14 is of a conventional construction and includes a generally rectangular heating unit 16 containing coil-type electrical resistance heating elements 18. Heating elements 18 are electrically connected in a conventional circuit to three power supply lines 21, 22 and 23 which, in turn, are connected to a controller 24 which controls the supply of current to the heating elements 18 to vary the heat output thereof. Controller 24 is connected by a power cable 26 to a two-prong electrical plug 28, which is constructed and arranged to be inserted into a conventional 115 volt household receptacle. The construction of the heating means 14, heating unit 16 and the power supply therefor, including lines 21–23, controller 24 etc., are conventional and typical of the heating pads in use today, although some heating pads are provided with a three-prong electrical plug, as will be discussed hereafter.

The shielding device 10 is constructed and arranged to block and contain the electromagnetic radiation emitted by the heating unit 18 and the power supply lines 21–23 to protect the user of the heating pad 14 from being exposed to such radiation and thereby obviate any possible medical problems that could be caused. To this end, cover 12 is constructed of a pair of sheet portions 30 and 31 joined at a linear fold 32 in an arrangement whereby the sheet portions 30 and 31 are joined in a hinge-like manner at the fold 32 so as to be movable between a closed position shown in FIG. 1 and an open position shown in FIG. 2. In the closed position, the sheet portions 30 and 31 extend in spaced apart generally parallel relation from the fold 32 so as to overlie one another with the heating unit 16 of heating pad 14 being contained therebetween and within the outer edge portions 34 and 35 of sheet portions 30 and 31, respectively. In the open position, the sheet portions 30 and 31 extend divergently from the fold 32 in an open relation to permit the insertion of the heating pad 14 in between sheet portions 30 and 31.

As best shown in FIG. 3, cover 12 is comprised of a flexible backing, preferably of a plastic such as vinyl, provided with an electrically conductive layer formed by a metallic coating 36 applied to the inner surface of the sheet portions 30 and 31 and fold 32 thereof.

In accordance with the invention, cover 12 is provided with an elongated extension portion adapted to enclose a substantial amount of the power supply wires 21–23. To this end, each of the sheet portions 30 and 31 is provided with an extension 38 and 39, respectively, extending from one end thereof as is best shown in FIGS. 1 and 2. Also, the power supply wires 21–23 that extend through the region of the extensions 38 and 39 are provided with a protective cover 25 of insulating material.

There is provided a fastening means for joining the edges of sheet portions 30 and 31 together in a closed condition when cover 12 is in its closed position. To this end, a zipper means 40 is applied to the overlapping edge portions of the sheet portions 30 and 31 to join them when cover 12 is in its closed position. Zipper means 40 is a conventional zipper-type closure which is shown in the closed condition in FIG. 1 and in the opened condition in FIG. 2. It will be apparent that other types of fastening means may be used to close the edges of the sheet portions 30 and 31, such as for example, Velcro-type fasteners.

Means are provided for preventing leakage of electromagnetic radiation through the joined edges of cover 12 when in its closed position. To this end, a flap 44 is sewed onto sheet portion 31, by stitching 46, to extend around the open edge portions thereof. As is shown in FIG. 2, flap 44 is located adjacent zipper means 40 throughout its entire extent. Flap 44 is made of a flexible plastic backing, such as vinyl, and is provided with an electrically conductive coating 45 on the outer surface thereof, as is best shown in FIG. 2. The stitching attachment of flap 44 to sheet portion 31 insures good electrical contact between conductive coatings 36 and 45. Flap 44 is flexible so that when cover 12 has a heating pad 14 placed therein, the free edge of the flap 44 can be folded over the edges of the heating pad 14 adjacent the zipper means 40 (see FIG. 3).

Figure 10:
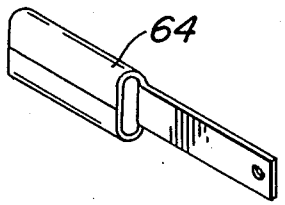
FIG. 10 is a perspective view of a socket/prong member used in the grounding means embodiments shown in FIGS. 2 and 5 and in FIGS. 6 and 7.
Figure 5:
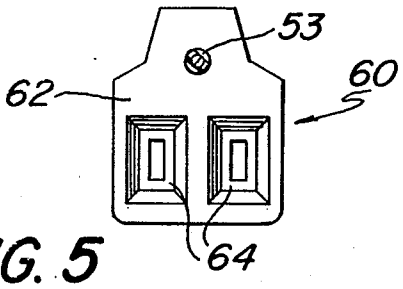
FIG. 5 is a sectional view taken on line 5—5 of FIG. 2.

There is provided ground means for electrically connecting the electrically conductive layer 36 of the cover 12 to ground. Such mean comprises a grounding wire 50 made of a length of insulated stranded tinned wire and having one end connected to a snap-type fastener 52 which is connected to the electrically conductive layer 36. The other end of the grounding wire 50 is connected to system ground or earth potential. In the embodiment of the invention shown in FIGS. 1–5, the grounding wire 50 is connected to an electrical plug adapter 60. Plug adapter 60 comprises a body 62, made of electrically insulating material and a pair of electrically conductive socket/prong members 64 embedded in body 62. Members 64 are constructed as shown in FIG. 10 and include socket portions adapted to receive the prongs of the two-prong plug 28, which is connected to the power supply lines of heating unit 16 as discussed above. Members 64 also include prong portions and are embedded in plug body 62 so as to provide a pair of electrically conductive prongs electrically connected at one end to said pair of sockets and having a portion extending from the plug body 62 for insertion into the power supply sockets of a conventional 115 volt household receptacle. Plug adapter 60 also includes a ground prong 64 which is embedded n and extends from said body 62 and is arranged for insertion into the ground socket of the conventional 115 volt household receptacle. The end 53 of grounding wire is mounted in the body 62 plug adapter 60 for connection to the ground prong 66.

Snap fastener 52 is shown in detail in FIG. 4 and includes a male snap member 54 adapted to snap into a female snap member 56. Members 54 and 56 are made of electrically conductive material, with member 54 being connected to grounding wire 50 for good electrical contact and member 56 being connected to conductive layer 36 for good electrical contact. Snap members 54 and 56 are plated or made of a suitable material such as stainless steel, so that they will not corrode or form an intermettalic growth at there interfaces with conductive film 36 or grounding wire 50. As would be well known in the art, care should be taken to prevent electric shocks, by providing adequate electrical insulation.

Figure 6:
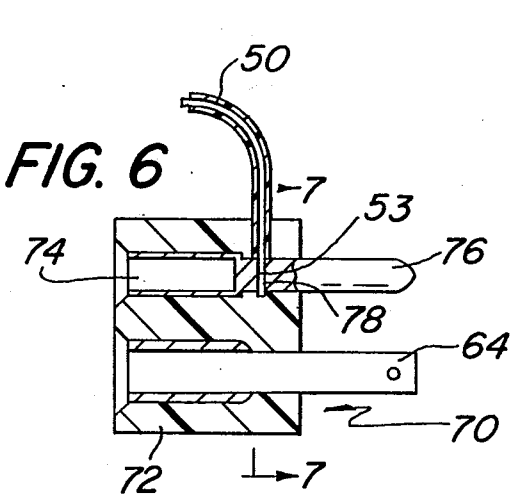
FIG. 6 is a sectional view of another embodiment of the grounding means.
Figure 7:
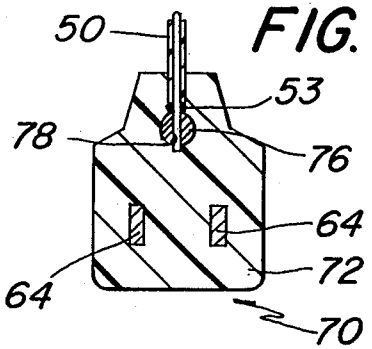
FIG. 7 is a sectional view taken on line 7—7 of FIG. 6.

In FIGS. 6 and 7 there is shown another embodiment of the grounding means in accordance with the invention. In this embodiment, there is provided an electrical plug adapter 70 having a body 72, made of electrically insulating material, and a pair of electrically conductive socket/prong members 64 embedded in said body 72. The parts are arranged so the socket portions of members 64 in body 72 are adapted to receive a pair of power supply prongs of a three-prong plug which is connected to the power supply lines of the heating unit 16 in the sam manner as plug 28 described with respect to the embodiment shown in FIGS. 1–5. Members 64 in body 72 have their prong portions arranged to provide a pair of electrically conductive prongs having a portion electrically connected to the pair of sockets and a portion extending from the plug body 72 for insertion into the power supply sockets of a conventional 115 volt household receptacle. Plug adapter 70 is also provided with a third one-piece electrically conductive socket/prong member providing a socket portion 74 for receiving the ground prong of said three-prong plug connected to the power supply lines of the heating unit 16 as discussed above and cylindrical ground prong 76 extending from the plug body 72 for insertion into the ground socket of said household receptacle. The end 53 of the grounding wire 50 is received in a hole 78 in prong 76 and is affixed to prong 76 by welding to make a good electrical contact therewith.

Figure 8:
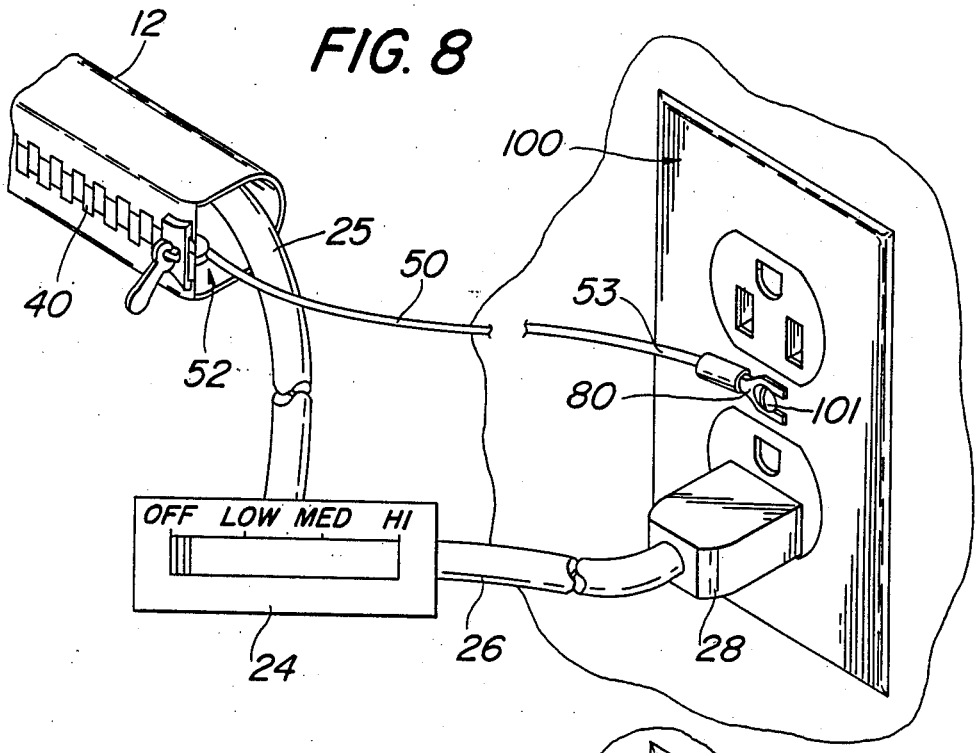
FIG. 8 is a perspective view showing still another embodiment of the grounding means.

In FIG. 8 there is shown another embodiment of the grounding means in accordance with the invention. In this embodiment the grounding wire 50 has its end 53 electrically connected to a spade lug 80 which is constructed and arranged to be connected to the box screw 101 of a conventional 115 volt household receptacle 100. By this arrangement, the grounding wire 50 is directly connected to the ground provided by the box screw 101 of receptacle 100.

Figure 9:
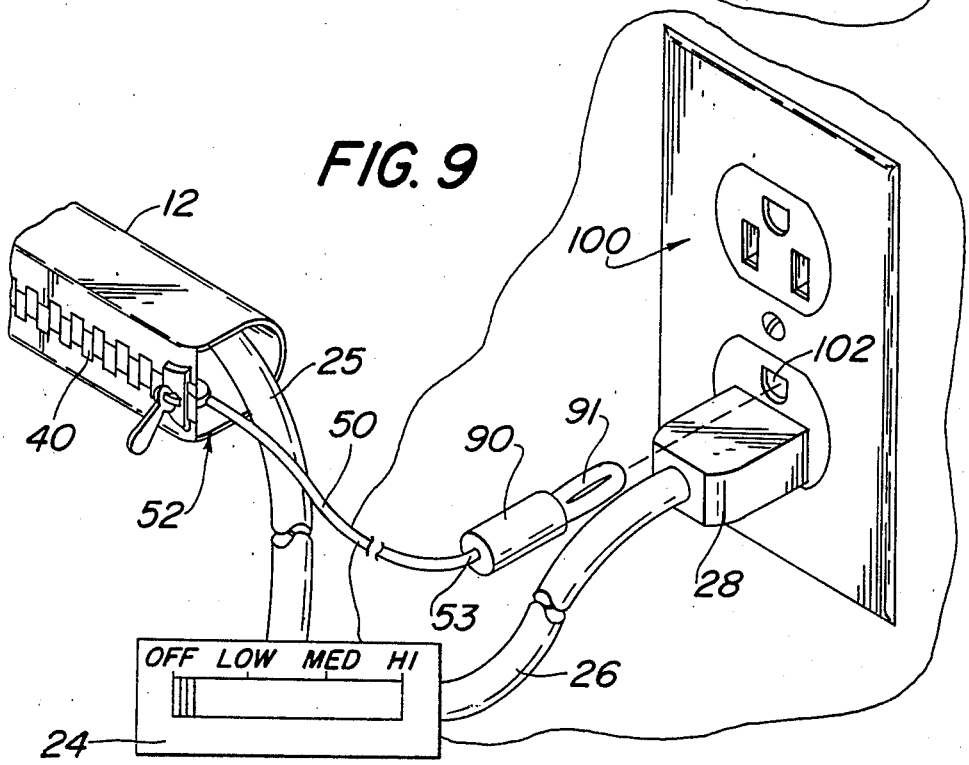
FIG. 9 is a perspective view showing a fourth embodiment of the grounding means.

In FIG. 9 there is shown another embodiment of the grounding means in accordance with the invention. In this embodiment grounding wire 50 is adapted to be plugged into the round female ground 102 of a conventional 115 volt household receptacle 100. To this end, the end 53 of grounding wire 50 is electrically connected to a male bayonet-banana-type plug 90 which has its prong portion 91 adapted to be received in the female ground socket 102. As is shown in FIG. 9, the receptacle 100 is provided with power supply sockets adapted to receive the prongs of the electrical plug member 28 of the heating means in a conventional arrangement.

It will be apparent that various changes may be made in the construction and arrangement of parts without departing from the scope of the invention which is defined by the claims. Thus, while there is described a shielding device for preventing the deleterious effects of the electromagnetic radiation given off by a conventional heating pad 14, the shielding device can be easily adapted for use with other products such as heating mattress pads or covers, blankets, pillows, lounge chairs, or similar electrically powered heating devices that come into contact or near contact with a human or an animal. Also, the shielding device can be adapted to be incorporated or designed into the materials used to fabricate such devices, as by shielding the individual heating wires if desired. Also, it will be noted that the electrically conductive film may be made of various metals other than aluminum, such as nickel or other suitable electrically conductive metals.

What is claimed is:

1. A device for shielding an electrically powered heating means having a resistive heating unit and power supply input wires so as to block and contain the electromagnetic radiation emitted thereby comprizing:

cover means including an external non-conductive backing and an internal electrically conductive layer constructed and arranged to enclose the resistive heating unit of the heating means fastened shut with a non-conductive closure, and detachable ground means for electrically connecting said internal electrically conductive layer of said cover means to ground, said detachable ground means includes a flexible grounding wire and a corrosion resistant metallic snap type fastener for convenient and repetitive detachment and reattachment of said ground means whereby one portion of the metallic snap type fastener is affixed to one end of said flexible grounding wire and the other portion of the fastener is affixed to said internal electrically conductive layer of the device so positioned that when said cover means is closed in a folded overlying relationship the metallic snap type fastener is contained within said non-conductive backing.

2. A device according to claim 1 wherein said external non-conductive backing insulates the intended user from accidental contact with the said internal electrically conductive layer which is grounded thus affording a safety factor when using the device in conjunction with other electrically powered devices that are non-grounded avoiding accidental extinguishment of life by electrocution.

3. A device according to claim 1 wherein said external non-conductive backing and internal electrically conductive layer are both of corrosion resistant materials to withstand the operation of conventional washing and drying or specialized sterilization, when ground means is detached and resistive heating unit is removed, to control the spread of disease.

4. A device according to claim 1 wherein said cover means is of a flexible sheet-like body construction, and wherein said internal electrically conductive layer is applied in a single homogeneous manner to one side of said flexible sheet-like body.

5. A device according to claim 4 wherein said sheet-like body includes a pair of sheet portions joined at a fold in an arrangement as not to disrupt the single homogeneous inner conductive layer while still allowing the sheet like body to be movable between an open position wherein said sheet portions extend from the said folded area in an open condition and a closed position wherein said sheet portions extend from said fold in overlying relationship for containing the heating unit or replacement of the heating unit therebetween.

6. A device according to claim 5 wherein said sheet-like body, including said single homogeneous inner conductive layer, comprizes an elongated extension portion adapted to enclose a substantial amount of power supply input wires blocking and containing the electromagnetic radiation emitted therefrom.

7. A device according to claim 5 including a flap extending along the inner joined edges of said body and overlying the same about the contained heating unit to prevent the leakage of electromagnetic radiation through the joined edges, wherein said flap is of a flexible non-conductive sheet-like strip having an electrically conductive coating on the outboard surface only and thus by intimate contact is electrically connected to both sheet portions completing a vessel containing the electromagnetic radiation emitted form the contained heating unit and power supply input wires.

8. A device according to claim 5 including a non-conductive fastening means, now relieved of the burden to complete the electrically conductive electromagnetic radiation containment, for joining the edges of said sheet portions together in a closed condition where said sheet portions are in said closed position thereof and thus not conveying accidental contact of an exposed ground to the user.

9. A device according to claim 8 wherein said fastening means includes a non-conductive zipper closure.

10. A device according to claim 1 wherein said flexible grounding wire is externally insulated to prevent accidental contact to ground.

11. A device according to claim 1 wherein said ground means includes a flexible and externally insulated grounding wire having one end electrically connected to said electrically conductive layer and an electrical plug adapter which supplies to the shield device a separate ground connection from a conventional household receptacle in addition to being supportive so as to also accept a standard male power plug of either two power prongs or two power prongs plus ground prong without affecting the conveyance of said externally insulated grounding wire to ground.

* * * * *